US006502965B1

(12) United States Patent
Bradford

(10) Patent No.: US 6,502,965 B1
(45) Date of Patent: Jan. 7, 2003

(54) LIGHT ASSEMBLY HAVING IMPROVED GLARE CONTROL AND INCREASED PERFORMANCE

(75) Inventor: Reed A. Bradford, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/551,093

(22) Filed: Apr. 18, 2000

(51) Int. Cl.[7] ..... F21V 7/00
(52) U.S. Cl. ..... 362/346; 362/277; 362/319
(58) Field of Search ..... 362/351, 356, 362/261, 277, 282, 319, 346

(56) References Cited

U.S. PATENT DOCUMENTS 1,397,803 A * 11/1921 Ensor et al. ..... 362/283
1,466,354 A * 8/1923 Drury ..... 362/298
4,338,655 A * 7/1982 Gulliksen et al. ..... 362/282
4,475,147 A * 10/1984 Kristofek ..... 362/346
4,725,934 A 2/1988 Gordin ..... 362/263
5,161,883 A 11/1992 Gordin et al. ..... 362/298
6,190,023 B1 * 2/2001 Leadford et al. ..... 362/297
6,203,176 B1 * 3/2001 Gordin ..... 362/297

* cited by examiner

*Primary Examiner*—Sandra O'Shea
*Assistant Examiner*—Peggy A Neils
(74) *Attorney, Agent, or Firm*—Fay, Sharpe, Fagan, Minnich, McKee, LLP

(57) ABSTRACT

A lighting assembly (10) is designed to control glare or spill light from an arc discharge lamp (12). A reflector insert (40) is formed from an identical reflector housing (14) and cut into an arcuate shape. An outer perimeter (42) is secured to the reflector housing and an inner perimeter (44) is adjustably secured to the reflector for subsequent manipulation or adjustment. The reflector insert advantageously has the contour of the primary reflector.

5 Claims, 2 Drawing Sheets

LIGHT ASSEMBLY HAVING IMPROVED GLARE CONTROL AND INCREASED PERFORMANCE

BACKGROUND OF THE INVENTION

1. Field of the Invention

This invention pertains to a light assembly, and more particularly to an arc discharge lamp having improved glare control such as used in outdoor lighting for sport fields and the like.

2. Discussion of the Art

Outdoor lighting fixtures have undergone drastic improvements over the past few years. However, glare light, i.e., light that spills or is directed to regions outside of the desired target area, remains a problem. The prior art is replete with a suggested solutions to the glare problem ranging from the use of shields or hoods that extend from the perimeter of the reflector housing to inserts or shields located between the lamp and the reflector, to occluding an end of the lamp, to orienting the lamp off-axis relative to the reflector housing axis. Where a number of lighting assemblies are positioned together on a lighting tower, each may have its own glare control structural features selected from one or more of various glare control solutions noted above. Although glare is thus reduced, it is only achieved with a substantial increase in the overall cost of manufacturing the lighting assemblies.

A need exists, therefore, for a simple and effective solution to reducing glare from a lighting assembly without a substantial increase in the manufacturing cost. This is particularly a concern with sports lighting so that spectators or nearby neighborhoods or businesses are unaffected by the stray or glare light.

BRIEF SUMMARY OF THE INVENTION

An improved lighting assembly incorporates a reflector insert that has the same contour as the reflective surface of the housing to control glare light.

An exemplary embodiment of the invention includes a housing that receives an arc discharge lamp. The lamp is received on axis within a symmetrical reflector. A reflector insert has the same contour as the primary reflective surface or primary reflector since it is obtained by cutting a reflector into individual pieces and trimming one of the individual pieces to form an insert. The reflector insert is then mounted between the lamp and the primary reflector to adjust the spill or glare light emanating from the lighting assembly.

A separate reflector housing is cut into generally equal-sized components to form multiple reflector inserts.

One perimeter edge of the insert is fixedly secured to the primary reflector. A second perimeter portion of the reflector insert is adjustably mounted to the primary reflector.

According to a preferred method of manufacture, a reflector housing is cut into an annular component that serves as a reflector insert for a primary reflector housing. The reflector insert is preferably secured along its outer perimeter to the reflector housing and secured via a threaded fastener along an inner perimeter to permit selective adjustment of the reflector insert relative to the primary reflector.

DETAILED DESCRIPTION OF THE INVENTION

Figure 1:
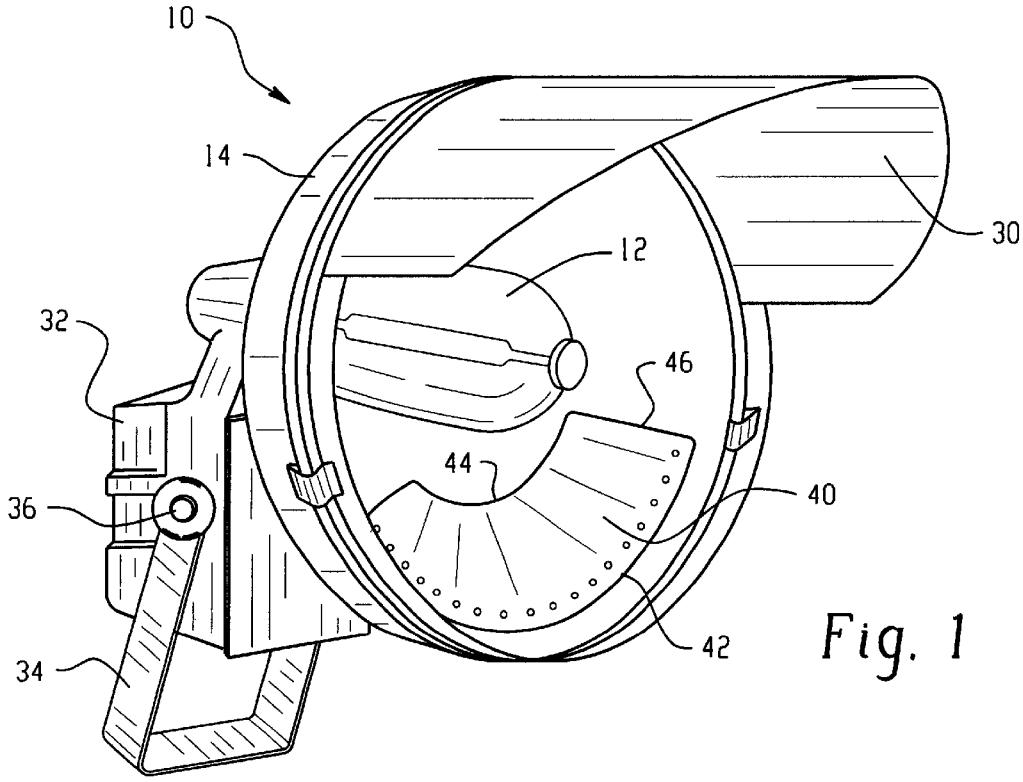
FIG. 1 is a perspective view of the lighting assembly in accordance with the present invention.
Figure 2:
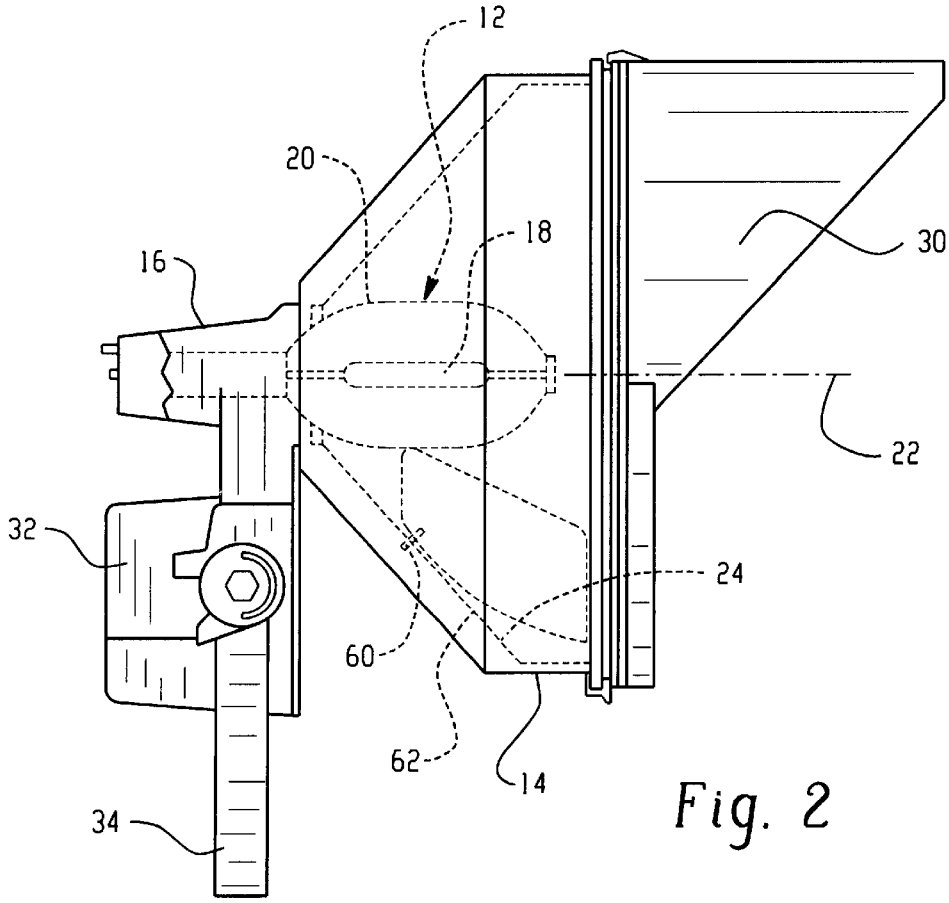
FIG. 2 is an elevational view of the lighting assembly of FIG. 1.
Figure 3:
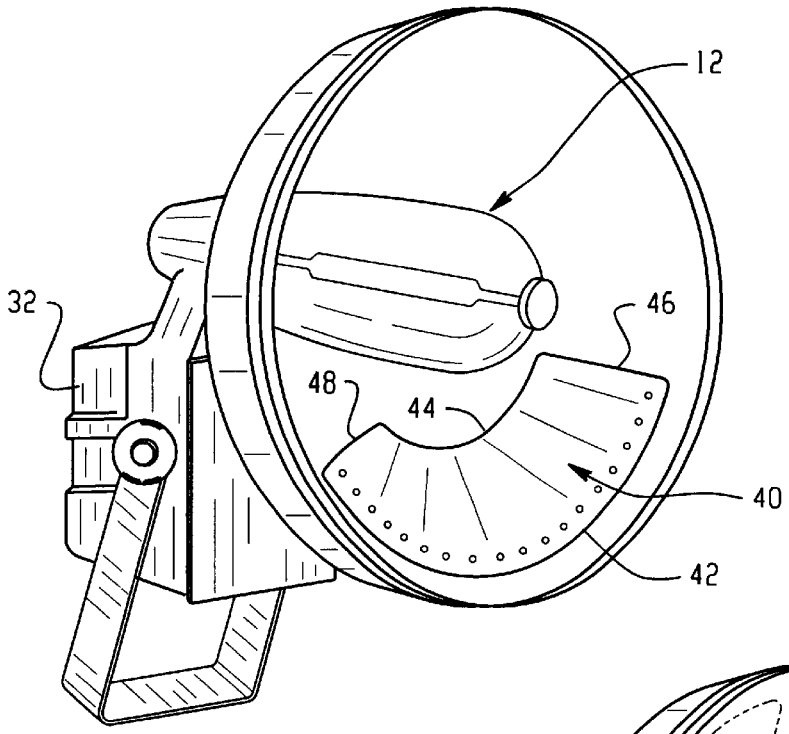
FIG. 3 is a perspective view similar to FIG. 1, in which a glare shield has been removed.

Referring now to the drawings, FIG. 1 shows a lighting assembly 10 having improved glare control and decreased manufacturing costs. A lamp, such as arc discharge lamp 12, is secured within a housing 14. Typically, one end of the arc discharge lamp is secured within a neck region or narrowed end 16 of the housing (FIG. 2). An arc discharge source or arc tube 18 received within the surrounding envelope 20 of the arc discharge lamp is located generally co-axial with a symmetrical axis 22 associated with first or primary reflector 24. As will be appreciated, the primary reflector may be integrally formed with the housing 14 or could be separately formed and secured to an interior surface of the housing. The primary reflector 24 has a surface of revolution such as a bowl-shaped reflector that receives light from the arc discharge source and directs it to a desired target region at an area remote from the lighting assembly. It will be appreciated that some light is emitted directly toward the target area without contacting the reflector. In order to prevent glare or waste a portion of the light, various devices can be used to control the glare. For example, a hood or shield 30 extends along the upper arcuate portion of the outer edge of the housing and controls spill light that would otherwise be directed upwardly and outwardly away from the target area. Likewise, the envelope 20 may be provided with selective masked regions that either prevent light from emanating directly forwardly generally along the axis 22 or reflect the light toward the primary reflector surface 24.

The electrical power components (not shown) of the lamp are sealed from the external environment in box 32. It is preferably integrally formed with or secured to the neck region 16 of the housing. An adjustable bracket 34 is pivotally secured via hinge pins 36 to the box to allow for adjustable mounting of the lighting assembly 10 from a mounting structure (not shown), such as a pole, mounting arm, etc.

Figure 5:
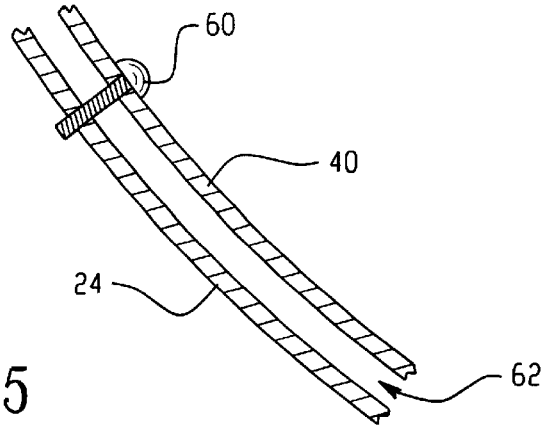
FIG. 5 is an enlarged view of the perimeter attachment of the reflector insert to the primary reflector housing.

The present invention provides for a reflector insert 40 that has the same or substantially similar contour as the primary reflector 24. The reflector insert 40 is preferably mounted between the lamp 12 and the primary reflector 24 to direct light that would otherwise be reflected by the primary reflector, change its angle of incidence, and redirect the light toward the target area. In the exemplary embodiment, the reflector insert defines a partial annular structure. It includes a first or outer perimeter 42 and a second or inner perimeter 44. Both the inner and outer perimeters are preferably arcuate or curvilinear in shape. Opposite edges 46, 48 extend substantially radially to define a partial annular section that is secured to the primary reflector. Preferably, the outer perimeter is fixedly secured to the first reflector. One manner of fixedly securing the outer diameter of the reflector insert is to spot weld the outer edge at spaced locations to the primary reflector, although it will be appreciated that other securing arrangements can be used without departing from the scope and intent of the subject invention. The inner perimeter 44, on the other hand, is adjustably secured to the first reflector. As is evident in FIGS. 1 and 5, a threaded fastener 60 interconnects the inner perimeter of the reflector insert with the first reflector or housing. As will be appreciated, rotating the threaded fastener in either direction alters the spacing or gap 62 between the reflector insert and the first reflector. This alters the incident and reflective angles of the light that reaches the reflector insert from the arc discharge lamp and allows for selective control or aiming of this light toward the desired target area.

Figure 4:
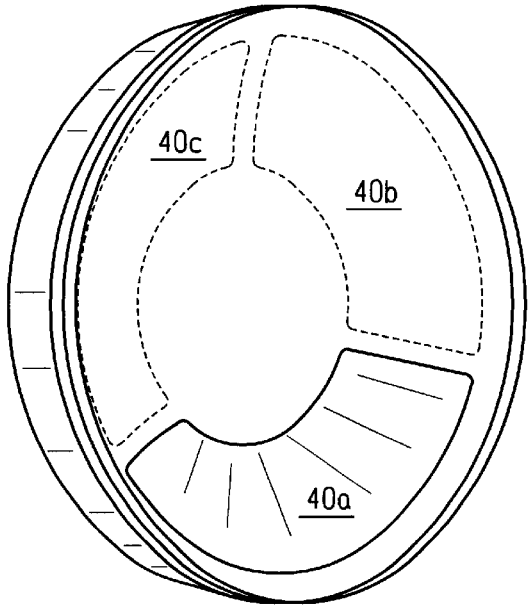
FIG. 4 is a perspective view of a primary reflector housing that is cut into three substantially equal components.

As exemplified in FIG. 4, the reflector inserts 40 for a particular light assembly are manufactured from one of the same reflector housings used as the primary reflector in each lamp assembly. In other words, no separate or special inventory of additional components is required. Instead, every fourth reflector housing, as manufactured, is subsequently cut into individual annular reflector inserts. In the preferred arrangement, a housing is cut into three individual inserts so that three complete light assemblies can be manufactured from four reflector housing. Each insert spans approximately one hundred twenty degrees (120°) of the total housing. If necessary, this angular extent can be varied as desired. This is best exemplified in FIG. 4, where three reflector inserts 40*a*, 40*b*, 40*c* are illustrated to be cut from a standard reflector housing. Of course, a greater or lesser number of inserts can be cut from a housing without departing from the teachings of the present invention.

This method of forming reflector inserts is also desirable since the resultant reflector insert has the same contour as the primary reflector housing. That is, it is not a planar element that is subsequently bent or formed to shape. Rather, the symmetrical reflector is formed as a surface or rotation and subsequently cut into the arcuate reflector inserts. This easily adapts the reflector inert to the environment of the primary reflector where it is easily secured to the primary reflector housing as described above. As will be appreciated since the reflector inserts are formed from a primary reflector housing, the reflector inserts are of the identical material as the primary reflector. This is typically an aluminum which is easy to form into the desired configuration and highly reflective when polished. A neck region 16 of the insert is removed and disposed of when the reflector inserts are made from the housing. However this method still minimizes the scrap material in forming the reflector inserts.

It will also be appreciated that alternative manners of connecting the insert to the housing can be used. Rather than fixedly securing the outer perimeter via more desirable than those that would otherwise deform the desired similar contour with the primary reflector.

The invention has been described with reference to the preferred embodiments. Obviously, modifications and alterations will occur to others upon a reading and understanding of the specification. For example, it is contemplated that the reflector insert can be used in conjunction with the glare shield or hood 30 or other devices intended to control glare. This invention is not intended to preclude such a combination. Likewise, the materials of construction may vary, the particular manner of adjustably fastening the reflector insert may be altered, or the number of inserts cut from a housing may three or another number. The invention is intended to include all such modifications and alterations insofar as the come within the scope of the appended claims or the equivalents thereof.

What is claimed is:

1. A lamp having improved glare control comprising:

a light source;

a housing receiving the light source and having a reflective surface having a bowl shape formed from a surface of revolution that directs light from the source toward a desired illumination area; and, a reflector insert adjustably secured to the housing along an inner periphery and fixedly secured along an outer periphery of the housing between the source and reflective surface, for directing light from the light source that would otherwise be reflected by the reflective surface, for changing an angle of incidence of the light, and for redirecting the light toward the desired illumination area, the reflector insert having a surface contour that is identical to a portion of the reflective surface, and a surface area approximately one-third of the reflective surface.

2. The lamp of claim 1 further comprising a threaded fastener securing the reflector insert along the inner periphery to the housing so that rotation of the fastener adjusts the orientation of the reflector insert relative to the housing.

3. The lamp of claim 1 wherein the light source is an arc discharge having an envelope aligned with an aiming axis of the reflective surface.

4. A method of manufacturing a lighting assembly comprising the steps of:

providing an arc discharge lamp;

securing the arc discharge lamp in a first symmetrical reflector;

cutting an identical second symmetrical reflector from an annular glare control shield;

adjustably securing an inner perimeter of the second symmetrical reflector to the first reflector; and fixedly securing an outer perimeter of the second symmetrical reflector to the first reflector.

5. The method of claim 4 wherein the second reflector is cut into three equal sized shields so that three lighting assemblies having improved glare control can be formed with four identical reflectors.

* * * * *